US006234855B1

(12) United States Patent
Watanabe et al.

(10) Patent No.: US 6,234,855 B1
(45) Date of Patent: May 22, 2001

(54) DRIVESHAFT HOUSING FOR OUTBOARD MOTOR

(75) Inventors: Kazuhiko Watanabe; Hiroyuki Suzuki, both of Shizuoka (JP)

(73) Assignee: Sanshin Kogyo Kabushiki Kaisha, Shizuoka (JP)

( * ) Notice: Subject to any disclaimer, the term of this patent is extended or adjusted under 35 U.S.C. 154(b) by 0 days.

(21) Appl. No.: 09/368,118

(22) Filed: Aug. 4, 1999

(30) Foreign Application Priority Data

Aug. 7, 1998 (JP) ..... 10-223779

(51) Int. Cl.[7] ..... B63H 20/32
(52) U.S. Cl. ..... 440/76; 440/78
(58) Field of Search ..... 440/76, 77, 78, 440/88, 89, 83

(56) References Cited

U.S. PATENT DOCUMENTS 3,025,824 3/1962 Foster .
3,434,447 3/1969 Christensen et al. .
3,908,579 9/1975 Miller et al. .
4,723,926 * 2/1988 Uehara ..... 440/76
5,026,309 * 6/1991 Onoue ..... 440/76

* cited by examiner

*Primary Examiner*—Stephen Avila
(74) *Attorney, Agent, or Firm*—Knobbe, Martens, Olson & Bear, LLP

(57) ABSTRACT

A driveshaft housing for an outboard motor includes an improved construction. The outboard motor comprises a power head containing an engine, the driveshaft housing depending from the power head and containing a driveshaft, and a lower unit depending from the driveshaft housing and supporting a propulsion device. The engine includes an exhaust system having an exhaust conduit at least in part extending through the driveshaft housing. The driveshaft housing has a rib extending from one lateral side wall portion to another lateral wall portion between the driveshaft and the exhaust conduit. The stiffening rib strengthen the rigidity of the lateral side walls of the driveshaft housing, and thereby inhibits inward and outward movement of the lateral side walls, particularly in a region where the walls define a portion of an expansion chamber of the exhaust system within the driveshaft housing.

25 Claims, 6 Drawing Sheets

DRIVESHAFT HOUSING FOR OUTBOARD MOTOR

BACKGROUND OF THE INVENTION

1. Field of the Invention

This invention relates to a driveshaft housing for an outboard motor, and more particularly to an improved driveshaft housing for an outboard motor that is reinforced against expansion and contraction force exerted thereon.

2. Description of Related Art

A conventional outboard motor generally includes a power head, a driveshaft housing and a lower unit. The power head contains an internal combustion engine. The driveshaft housing depends from the power head and contains a driveshaft that is driven by said engine. In particular, a crankshaft of the engine drives the driveshaft. Since the crankshaft extends generally vertically in the power head, the driveshaft also extends generally vertically in the driveshaft housing. The lower unit depends from the driveshaft housing and contains a propulsion device such as a propeller. The driveshaft drives the propulsion device through a conventional transmission. Thus, the watercraft associated with the outboard motor is propelled by the outboard motor.

The engine usually has an exhaust system for discharging exhaust gases from its combustion chamber(s) to the body of water surrounding the outboard motor. The exhaust system has an exhaust conduit that extends through the driveshaft housing and the lower unit. Exhaust gases flow through the exhaust conduit downwardly and are finally discharged to the body of water through an opening, for example, formed in a propeller hub.

The exhaust gases, immediately after discharged from the engine into the exhaust conduit, have tremendous expansion pressure and this pressure acts on the wall of the driveshaft housing as well as on any internal walls within the driveshaft housing that define the exhaust conduit. The discharge of the exhaust gases intermittently and repeatedly occurs every exhaust stroke of the engine. Accordingly, the housing walls will be intermittently and repeatedly stressed by the fluctuating expansion pressures.

In the meantime, the driveshaft housing is configured generally as an oval shell in a plan view with its major axis extending between fore and aft ends of the housing. The lateral or side wall portions, therefore, are weaker (i.e., less rigid) than the fore and aft wall portions. If rigidity of these portions is not sufficient, vibration occurs when the aforenoted expansion pressure acts upon them. In addition, the engine per se generates relatively large vibration and this vibration is also transmitted to the housing shell. Hence, the lateral walls tend also to be stressed by these vibrations. If the frequency of the vibrations is consistent with the inherent frequency of vibration of the housing shell, resonance will occur and this results in discernable noise.

SUMMARY OF THE INVENTION

It is appreciated that the vibration and the sound in consequence can be prevented if thickness of the housing wall is increased. This structure, however, also increases the weight of the driveshaft housing and the total weight of the outboard motor performance suffers as a result. A need therefore exists for a driveshaft housing of an outboard motor that can withstand the noted vibrations without significantly increasing weight of the outboard motor.

In accordance with one aspect of this invention, an outboard motor comprises a power head. The power head contains an internal combustion engine. A driveshaft housing depends from the power head. The driveshaft housing contains a driveshaft driven by the engine and extending generally vertically. A lower unit depends from the driveshaft housing. The lower unit contains a propulsion device driven by the driveshaft for propelling an associated watercraft. The engine includes an exhaust system for discharging exhaust gases from the engine. The exhaust system has an exhaust conduit extending, at least in part, through the driveshaft housing. The driveshaft housing has at least two side wall portions. The driveshaft housing also has a rib transversely extending from one side wall portion to the other side wall portion and between the driveshaft and the exhaust conduit.

In accordance with another aspect of this invention, an outboard motor comprises a power head. The power head contains an internal combustion engine. A driveshaft housing depends from the power head. The driveshaft housing contains a driveshaft driven by the engine. The driveshaft extends generally vertically through at least a front portion of said driveshaft housing located forward of a central longitudinal axis of the driveshaft housing. A lower unit depends from the driveshaft housing. The lower unit contains a propulsion device driven by the driveshaft for propelling an associated watercraft. Means are provided for reinforcing the driveshaft housing against force transversely acting thereon. The means for reinforcing the driveshaft housing are disposed within the front portion of said driveshaft housing.

Further aspects, features and advantages of this invention will become apparent from the detailed description of the preferred embodiment which follows.

BRIEF DESCRIPTION OF THE DRAWINGS

These and other features of this invention will now be described with reference to the drawings of a preferred embodiment which is intended to illustrate and not to limit the invention.

DETAILED DESCRIPTION OF THE PREFERRED EMBODIMENT OF THE INVENTION

Figure 1:
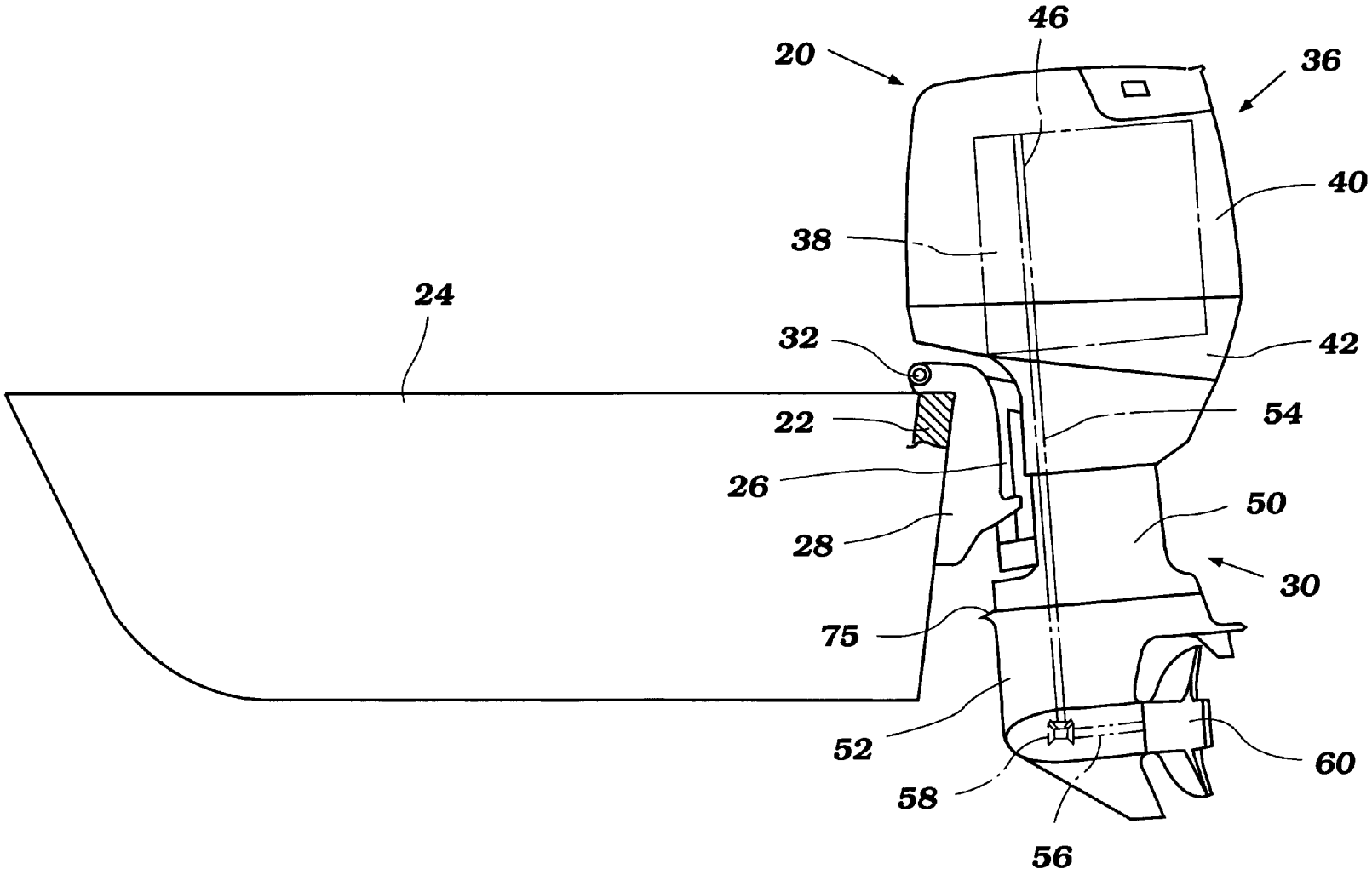
FIG. 1 is a side elevational view showing an out board motor embodying features of this invention and an associated watercraft on which the outboard motor is mounted. A transom of the watercraft is partially shown in a cross-sectional view.
Figure 2:
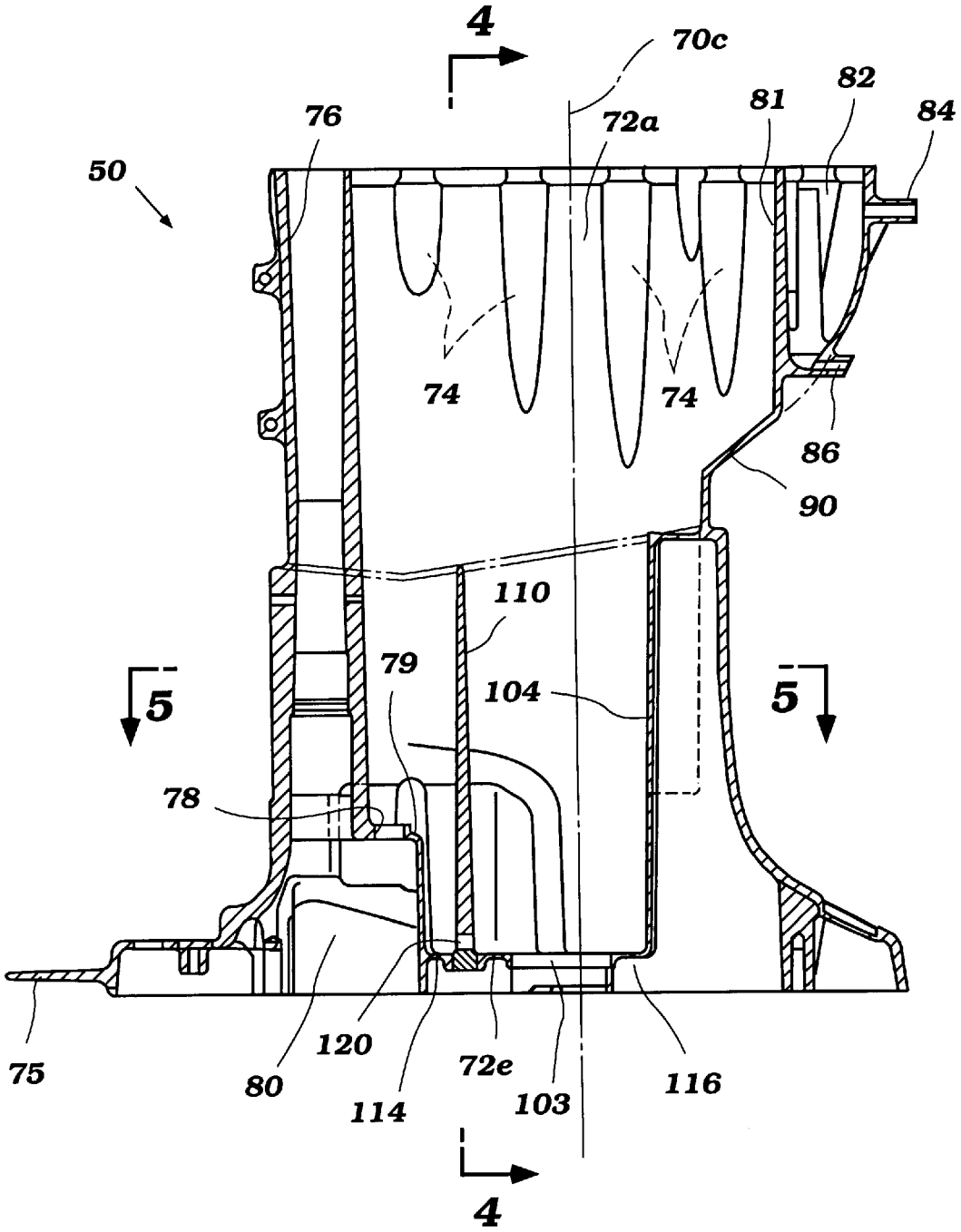
FIG. 2 is an enlarged cross-sectional, side elevational view, taken along the line 2—2 in FIG. 3, showing a driveshaft housing.

At first, the general overall environment of an exemplary outboard motor wherein the invention is practiced will be described with reference to FIG. 1.

An outboard motor generally indicated by the reference numeral 20 is mounted on a transom 22 of an associated watercraft 24 by means of a swivel bracket 26 and a clamp bracket 28. That is, a drive unit generally indicated by the reference numeral 30 is pivotally supported around a generally vertically extending axis of the swivel bracket 26 and this connection allows the drive unit 30 to be steered laterally. The drive unit 30 including the swivel bracket 26 is also pivotally supported around a horizontally extending axis of the clamp bracket 28, which is the axis of a tilt pin 32, so that its trimming and tilting movements are practicable also.

In the following descriptions, the term "fore," "forward," "front," "forth" or "forwardly" will mean at or to the side where the clamp bracket 28 is located and the term "aft," "rearward," "back" or "rearwardly" will mean at or to the opposite side of the fore side unless depicted otherwise. "Lateral" means in a direction extending between front and aft, while "transverse" means in a direction generally normal to a lateral axis (that extends in the defined lateral direction) and to a longitudinal axis of the outboard motor (this longitudinal axis generally being vertically oriented in the illustrated embodiment).

A power head 36 is provided at the top of the drive unit 30. The power head 36 includes a powering internal combustion engine 38. This engine 38 operates, for example, on a four stroke principle and has four cylinders disposed in line and spaced generally vertically relative to each other. Any type of engines, however, can be applicable for the outboard motor embodying this invention. For instance, a two stroke engine, a V-shaped engine, a single cylinder engine and multiple cylinder engine are all practicable.

Although not shown, the engine 38 is generally provided with an air intake system, an exhaust system, a fuel supply system, a firing system, a cooling system and other components necessary for the engine operation. The exhaust system is provided for discharging exhaust gases outside from the engine 38.

The power head 36 further includes a top cowling 40 and a bottom cowling 42. These top and bottom cowlings 40, 42 generally completely encircle the engine 38 so as to protect it. For instance, water is prevented from splashing over the engine 38. The top cowling 40 is detachably affixed to the bottom cowling 42 so as to ensure access to the engine 38 for maintenance. The engine 38 has a crankshaft 46 extending generally vertically. The crankshaft 46 in the illustrated embodiment operates as an output shaft by which the rotational power of the engine 38 is outputted.

A driveshaft housing 50 depends from the power head 30, and a lower unit 52 further depends from the driveshaft housing 50. A driveshaft 54 extends downwardly in the driveshaft housing 50 and the lower unit 52. The top end of the driveshaft 54 is connected with the crankshaft 46 to be driven thereby. The bottom end of the driveshaft 54 is connected with a propeller shaft 56, which extends generally normal to the driveshaft 54, by means of a bevel gear transmission 58. At the end of the propeller shaft 56, a propeller 60 is affixed. Thus, the engine 38 powers the propeller 60 through the crankshaft 46, the driveshaft 54, the bevel gear transmission 58 and the propeller shaft 56. Additionally, part of the exhaust system passes through the driveshaft housing 50 and the lower unit 52 and this part will be described more in detail shortly.

Referring now to FIGS. 2 through 6, the driveshaft housing 50 will be described below.

Figure 3:
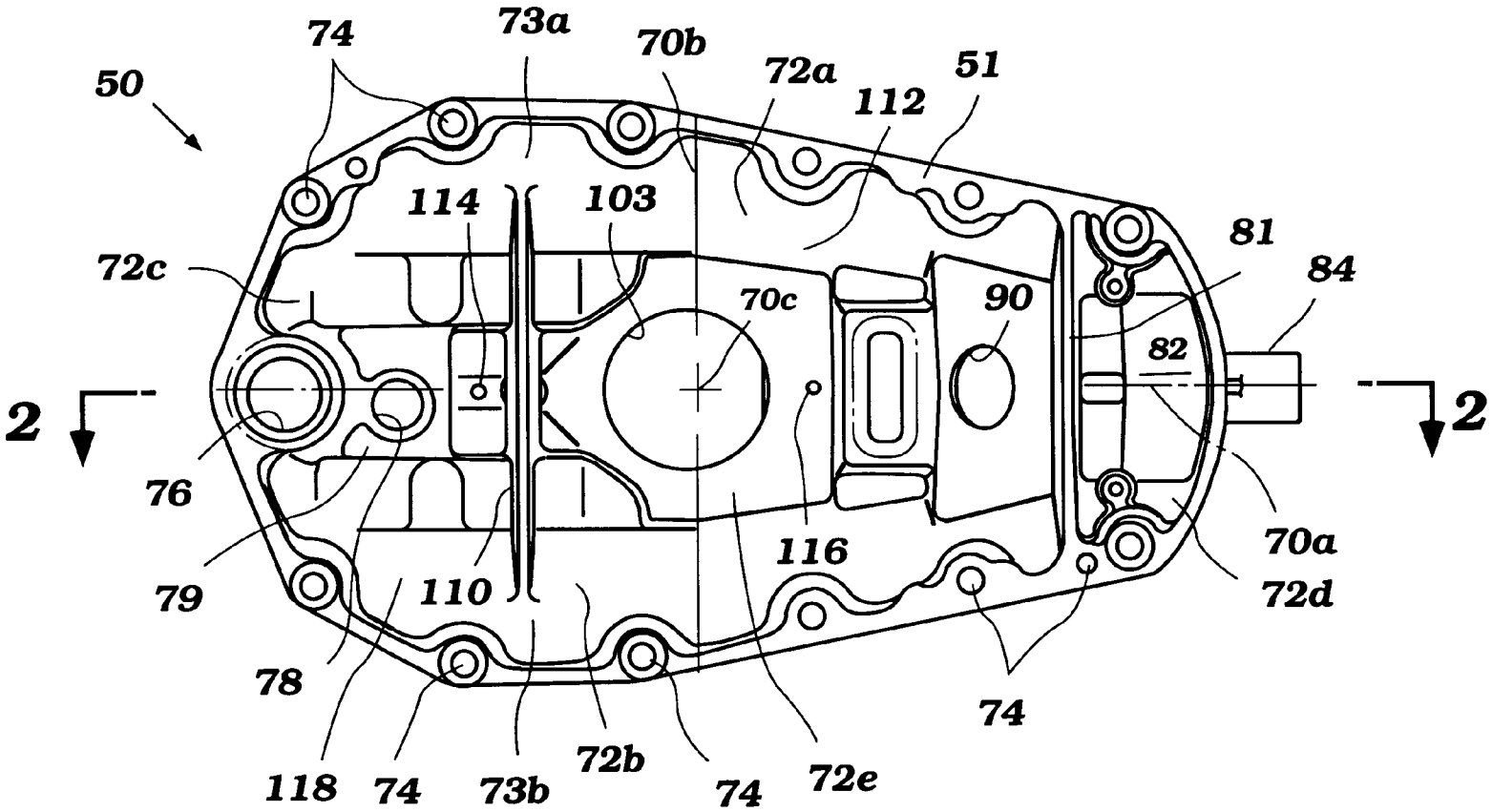
FIG. 3 is a top plan view showing the driveshaft housing without any components. A splash plate is also omitted in this figure.
Figure 4:
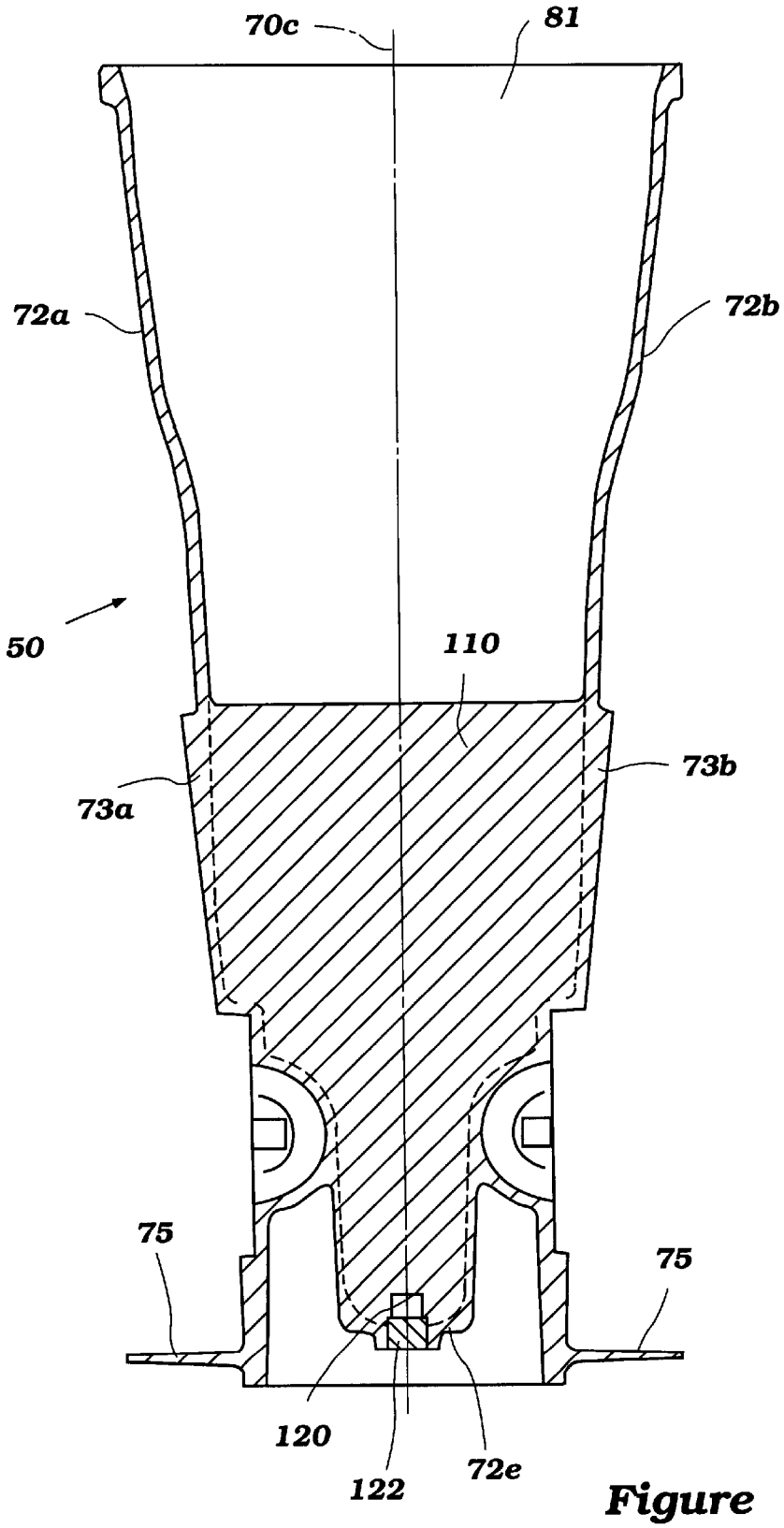
FIG. 4 is an enlarged cross-sectional, front elevational view, taken along the line 4—4 in FIG. 2, showing the driveshaft housing.
Figure 5:
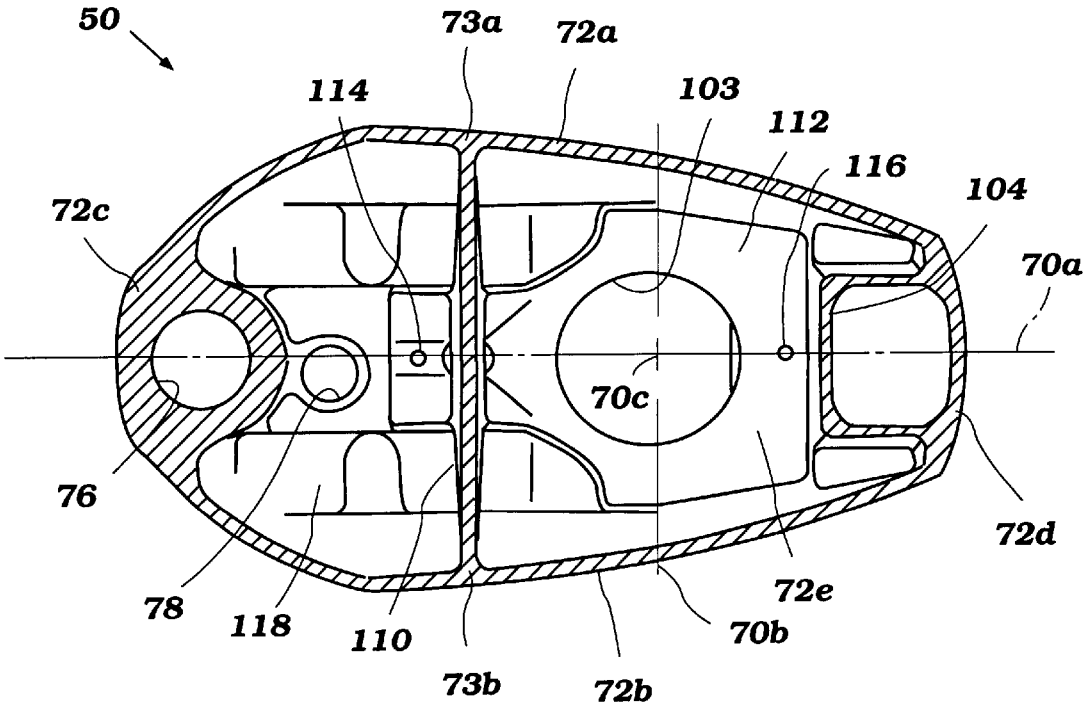
FIG. 5 is a cross-sectional, top plan view, taken along the line 5—5 in FIG. 2, showing the driveshaft housing. The splash plate is also omitted in this figure.

As best seen in FIGS. 3 and 5, the driveshaft housing 50 includes a housing shell 51. The housing shell 51 is configured generally as an oval shell in a top plan view and its major axis 70*a* exists fore to aft while its minor axis 70*b* exists side to side. The oval shell shape of the housing provides a stream-line structure to minimize drag on the outboard motor and also reduces weight of the outboard motor.

The major and minor axes 70*a*, 70*b* of the oval shape intersect at a central vertical axis 70*c*. As seen in FIG. 3, the central vertical axis 70*c* lies at the center of the oval shape at the top of the driveshaft housing 50, while the central vertical axis 70 lies nearer a rear end of the housing when viewed in cross-section at about mid height of the drive shaft housing 50, as understood from FIG. 5. This occurs because the driveshaft housing 50 does not have a uniform cross-sectional shape over its height. The drive shaft housing rather tapers in its lateral dimension at about its mid-point in the vertical direction, as best understood from FIGS. 1 and 2.

The housing shell 51 can be made of aluminum alloy die-casting; however, the housing shell 51 can be made of a variety of other materials and formed by any of a number of ways readily known in the art. Incidentally, the bottom cowling 42 and the lower unit 52 are also desirably made of aluminum alloy die-casting. The housing shell 51 is generally formed with upright walls, which includes lateral walls 72*a*, 72*b* and end walls 72*c*, 72*d*, and a bottom wall 72*e*. These walls 72*a*, 72*b*, 72*c*, 72*d*, 72*e* are integrated with each other, i.e., they form a unitary structure. The thickness of the lateral and end walls 72*a*, 72*b*, 72*c*, 72*d* increase at about the middle of the shell's height. As seen in FIG. 3, some bolt holes 74 are provided at the top of the upright walls 72*a*, 72*b*, 72*c*, 72*d* and the bottom cowling 42 is affixed to the driveshaft housing 50 with bolts. These bolt holes 74 are formed bosses that project inward into the space within the housing shell 51, as best understood from FIG. 2. In a like manner, the driveshaft housing 50 is affixed to the lower unit 52.

The housing shell 51 has a splash plate 75 extending generally forwardly at the bottom and outer forward periphery. The splash plate 75 is provided for preventing water from splashing into the watercraft 24 when the outboard motor 20 propels the associated watercraft 24, as well known in the art.

At the most forward portion of the driveshaft housing 50, a hollow space 76 is formed through which the driveshaft 54 extends. In the proximity of this hollow 76, an aperture 78 is formed at a step 79, which is generally a forward end of the bottom wall 72*e*. Although not shown, a cooling water supply passage passes through this aperture 78. A water pump (also not shown) is provided near and is driven by the driveshaft 54 in a compartment 80 formed under the step 79 to draw water from the surrounding body of water and then to supply it to the engine 38 as coolant through water supply passages therein.

At the most rearward and upper position of the driveshaft housing 50, a partition 81 is formed and integrated with the lateral walls 72*a*, 72*b*. The space 82 behind the partition 81 is an idling exhaust chamber. The idling exhaust chamber 82 is one part of the aforenoted exhaust system and a relatively less amount of the exhaust gases at the idling or slow speed of the engine 38 are accepted in this chamber 82 and then discharged to the atmosphere through an idling exhaust outlet 84. Some of the cooling water, which has flowed through water jackets in the engine 38, is also received in this chamber 82 for cooling the chamber and also for discharge through an idling water outlet 86.

Figure 6:
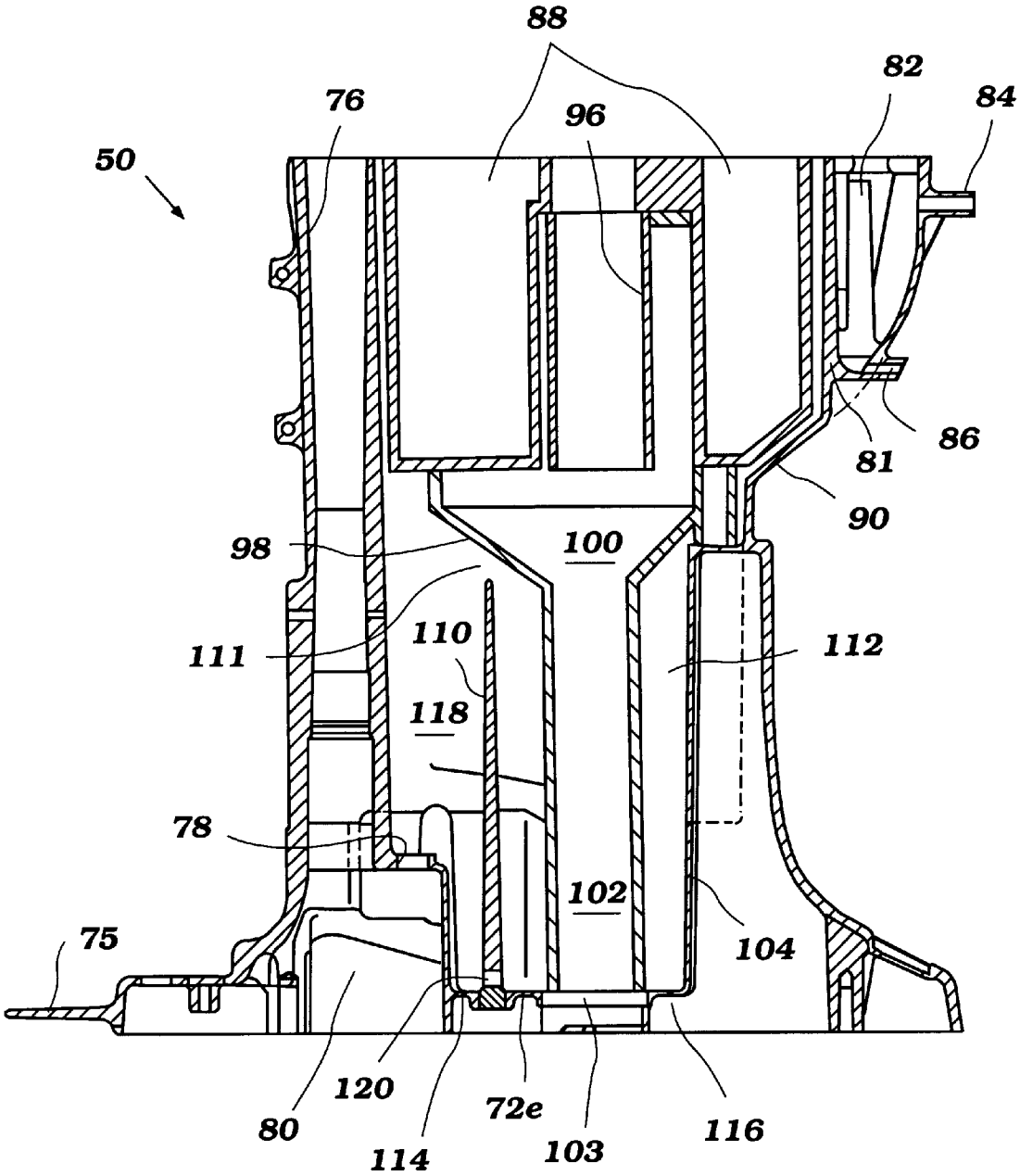
FIG. 6 is a cross-sectional, side elevational view, taken along the line 2—2 of FIG. 3 showing the driveshaft housing with some components provided therein.

As best seen in FIG. 6, an oil pan assembly 88 is placed between the driveshaft hollow 76 and the partition 81 at generally the upper end of the driveshaft housing 50. The oil pan assembly 88 is configured generally as a circular shape and connected to the bottom of the engine 38 or an exhaust guide (not shown). Lubricant or oil for lubrication of engine components is supplied from this oil pan assembly 88 and returned thereto after circulating through the engine. The oil pan assembly 88 is slightly schematically illustrated in this figure and a plug for the oil pan assembly 88 is omitted. Actually, however, an opening 90 through which the plug can be accessed is provided on the rear side of the housing shell 51.

In the illustrated embodiment, a majority of the exhaust gases pass thorough the driveshaft housing 50 and the lower unit 52. Then, they are finally discharged to the body of water surrounding the outboard motor 20 through a discharge passage formed in a boss of the propeller boss 60. For this purpose, exhaust conduit members 96, 98 are provided within the housing shell 51. The member 96 is an exhaust pipe and depends generally from a part of the exhaust system in the engine 38. This exhaust pipe 96 is generally surrounded by the circular shape of the oil pan assembly 88. The other member 98 generally forms an expansion chamber 100 and an exhaust passage 102. The expansion chamber 100 has a relatively large capacity and affixed to the bottom of the oil pan 88 air-tightly. The exhaust passage 102 is again narrowed and joined with another passage (not shown) in the lower unit 52 at an opening 103 formed in the bottom wall 72*e*. In the illustrated embodiment, the opening 103 is on the major axis 70*a* of the housing shell 51, as best seen in FIGS. 3 and 5. That is, the aforenoted driveshaft hollow 76 and the exhaust conduit member 98 are generally centered relative to the same axis 70*a*. The opening 103 desirably lies generally at the center of the driveshaft housing 50 toward the upper and lower ends of the housing 50, and may be positioned relative to the central vertical axis 70*c*, as seen in FIGS. 3 and 5.

As seen in FIG. 5, another partition 104 is formed behind the downstream passage 102. This partition 104 is joined with the bottom wall 72*e* and extends up to about the mid height generally the middle position of the lateral walls 72*a*, 72*b*. That is, the partition 104 is formed with the walls 72*a*, 72*b*, 72*c*, 72*d*, 72*e* in the casting process of the housing shell 50.

The exhaust gases, immediately after discharged into the driveshaft housing 50 from the engine 38, expand and generate tremendous pressure waves. The capacity of the upstream chamber 100 is useful to have the exhaust gases release the energy by abruptly expanding and attenuate noise made by the exhaust gases.

Such expansion exerts forces upon the upright walls 72*a*, 72*b*, 72*c*, 72*d*, particularly in a transverse direction upon the lateral walls 72*a*, 72*b*. In addition, the discharge of the exhaust gases from the engine 38 occurs intermittently and repeatedly as the engine 38 cycles. As described above, the lateral walls 72*a*, 72*b* have a tendency to vibrate, moving in and out in the transverse direction, in part due to the shape of the housing shell 50.

In order to prevent the lateral walls 72*a*, 72*b* from vibrating, the driveshaft housing 50 has a rib 110 extending between lateral wall portions 73*a*, 73*b*. In the illustrated embodiment, the rib 110 is formed in the casting process and hence integrated with the lateral walls 72*a*, 72*b*; however, the rib 110 may be separately attached to the walls 70*a*, 70*b* of the housing shell 51. The rib 110 extends between the driveshaft hollow 76 and the exhaust conduit member 98 and transversely, as seen in FIGS. 3 and 5, between the lateral walls 72*a*, 72*b* at or near a point of maximum separation between the lateral walls 72*a*, 72*b*. In a preferred mode, the rib 110 extends normal to the major axis 70*a* of the housing shell 51. Since the exhaust conduit member 98 is positioned at almost center of the housing shell 50, the rib 110 is positioned within a forward half section of the housing shell 50 in a plan view, in front of the vertical center axis 70*e*. Also, as best seen FIG. 4, the rib 110 is formed from the bottom wall 72*e* up to about the mid-height of the housing shell 51.

The rib 110 becomes thinner (i.e., tapers in thickness) toward its upper end. The top of the rib 110 is positioned under the expansion chamber 100 of the exhaust conduit member 98, but is not connected to either the exhaust conduit member 98 or the oil pan assembly 88. That is, there is a space 111 between them.

The cooling water, which has flowed through the water jackets in the engine 38, is also principally discharged through the driveshaft housing 50 and the lower unit 52. The water flows down into the driveshaft housing 50 through one or more passages formed in an exhaust guide (not shown). Because the lubrication oil returned to the oil pan 88 has some heat, it is advantageous to cool the oil pan 88 with this discharged cooling water. However, as described above, the exhaust gases have huge energy manifested in the form of heat and pressure. Thus, it is desirable to supply a relatively large part of the cooling water to the exhaust conduit members 96, 98. The partition 104 and the rib 110 are useful to collect water particularly around the exhaust conduit member 98. A recess or sub-space 112 is formed by the partition 104, the rib 110 and the walls 72*a*, 72*b*, 72*e*, the cooling water may accumulate in this recess 112 and around the exhaust passage 102 when the engine speed is relatively high. This can be useful to cool the exhaust conduit member 98 further.

Apertures 114, 116 are provided in the bottom wall 72*e* to drain the water. The aperture 114, as one drain, is formed in front of the rib 110. In this area, another recess or sub-space 118 is formed because it is surrounded by the walls 72*a*, 72*b*, 72*c*, and the rib 110. Thus, water, which flows into this recess 118, will drain through the aperture 114 and will flow into the lower unit 52. Meanwhile, the aperture 116, as another drain, is formed at the bottom of the other recess 112. Accordingly the water dropped into the recess 112 is also drained through this aperture 116 and flows into the lower unit 52.

In addition, an opening 120 is provided at the bottom of the rib 110 so that the water in the front recess 118 can move to the rear recess 112 and also the water in the rear recess 112 can move to the front recess 118. This opening 120 can be made when the housing shell 50 is cast. Because of this, originally the opening 120 is opened downwardly and then a cap 122 is inserted into the opening to close the bottom portion.

Water in the rear recess 112 also can move to the front recess 118 over the rib 110 by passing through the space 111 when the drive unit 30 is tilted up. In any way, the water in both of the recesses 112, 118 can be drained smoothly to the lower unit 52 by flowing or passing through the opening 120 or the space 111 and the drain holes 114, 116 and finally discharged to the body of water surrounding the outboard motor 20 through the boss of the propeller 60 along with the exhaust gases.

The rib 110 strengthens the rigidity of the lateral walls 72*a*, 72*b* and inhibits inward and outward movement of the lateral walls 72*a*, 72*b*, particularly in the region where these walls for a portion of an expansion chamber. The rib 110 thus reinforces the housing shell 50 and inhibits the vibration of the lateral walls 72*a*, 72*b*. Thus, resonance seldom occurs and hence the outboard motor is quieter.

The rib 110 has a relatively small volume in comparison to a wall thickness required to accomplish the same effects. Thus, the weight of the rib 110 is still smaller than the presumed weight of additional thickness of the lateral walls 72*a*, 72*b*.

Further, since the rib 110 extends from the bottom wall 72*e* up to the middle position of the housing shell 50, the lateral walls 72*a*, 72*b* will not have distortion thereof in a relatively large area of the lateral walls 72*a*, 72*b*.

Furthermore, since the rib 110 is positioned in front of the exhaust conduit member 98, the rib 110 does not preclude exhaust gases from flowing through the driveshaft housing 50.

It should be noted that height of the rib 110 is changeable. For instance, it can extend all the way from the bottom to the top of the housing shell 50. It is also possible that the rib 110 does not reach the bottom of the housing shell 50.

Also, components such as an oil pan assembly 88 and the exhaust conduit members 96, 98 can be arranged in various ways in the housing shell 51. It is desirable, however, that the rib 110 is positioned in front of the exhaust conduit members 96, 98 so that flow of the exhaust gases is not impaired by the rib 110.

The opening 120 at the bottom of the rib 110 can be formed as a slit extending, for example, horizontally. Inasmuch as that the opening 120 is provided, one of the drain holes 114, 116 is dispensable. In this regard, however, it is better to provide the drain hole 114 rather than the drain hole 116 because the drive unit 30 can be tilted up. Also, inasmuch as that both of the drain holes 114, 116 are provided, the opening 120 is dispensable.

Also, a plurality of openings 120 can be provided at the rib 110 instead of the single opening 120 for connecting both of the recesses 112, 118. Although the openings 120 can be placed at any positions, it is desirable to dispose at least one of the openings 120 at the bottom of the rib 110. The number and positions of the drain holes 114, 116 also changeable, and may be readily adapted by one skilled in the art to tailor water flow through the driveshaft housing 50.

In addition, the driveshaft housing 50 can include additional stiffening ribs if space in the housing shell 51 is available.

Of course, the foregoing description is that of a preferred embodiment of the invention, and various changes and modifications may be made without departing from the spirit and scope of the invention, as defined by the appended claims.

What is claimed is:

1. An outboard motor comprising a power head containing an internal combustion engine, a driveshaft housing depending from said power head and containing a driveshaft driven by said engine and extending generally vertically, and a lower unit depending from said driveshaft housing and including a propulsion device driven by said driveshaft, said engine communicating with an exhaust system for discharging exhaust gases from said engine, said exhaust system including an exhaust conduit extending through said driveshaft housing at least in part, said driveshaft housing having at least two lateral side wall portions, a bottom wall portion, and a rib generally transversely extending from one of said lateral side wall portions to another one of said lateral side wall portions between said driveshaft and said exhaust conduits, said rib also extending generally upwardly from said bottom portion.

2. An outboard motor as set forth in claim 1, wherein said rib extends generally normal to a major axis of said driveshaft housing that extends between fore and aft ends of the driveshaft housing.

3. An outboard motor as set forth in claim 2, wherein said driveshaft and said exhaust conduit are generally centered about the major axis.

4. An outboard motor as set forth in claim 1, wherein said driveshaft is disposed generally at a forward end of said driveshaft housing.

5. An outboard motor as set forth in claim 4, wherein said exhaust conduit is disposed generally at the center of the driveshaft housing.

6. An outboard motor as set forth in claim 1, wherein said rib extends between respective sections of said lateral side wall portions which are generally spaced from each other at a maximum distance.

7. An outboard motor as set forth in claim 1, wherein said rib is unified with said lateral side wall portions.

8. An outboard motor as set forth in claim 1, wherein said rib is cast with said driveshaft housing.

9. An outboard motor as set forth in claim 1, wherein said rib divides an internal space of said driveshaft housing into at least two sub-spaces, and said exhaust conduit passes through one of said sub-spaces.

10. An outboard motor as set forth in claim 1, wherein said rib is unified with said bottom wall portion.

11. An outboard motor comprising a power head containing an internal combustion engine, a driveshaft housing depending from said power head and containing a driveshaft driven by said engine and extending generally vertically, and a lower unit depending from said driveshaft housing and including a propulsion device driven by said driveshaft, said engine communicating with an exhaust system for discharging exhaust gases from said engine, said exhaust system including an exhaust conduit extending through said driveshaft housing at least in part, and said driveshaft housing having at least two lateral side wall portions, and a rib generally transversely extending from one of said lateral side wall portions to another one of said lateral side wall portions between said driveshaft and said exhaust conduit, said rib decreasing in thickness toward its upper end.

12. An outboard motor comprising a power head containing an internal combustion engine, a driveshaft housing depending from said power head and containing a driveshaft driven by said engine and extending generally vertically, and a lower unit depending from said driveshaft housing and including a propulsion device driven by said driveshaft, said engine communicating with an exhaust system for discharging exhaust gases from said engine, said exhaust system including an exhaust conduit extending through said driveshaft housing at least in part, said driveshaft housing having at least two lateral side wall portions, and a rib generally transversely extending from one of said lateral side wall portions to another one of said lateral side wall portions between said driveshaft and said exhaust conduit, said rib dividing an internal space of said driveshaft housing into at least two sub-spaces, and said exhaust conduit passes through one of said sub-spaces, respective bottoms of said sub-spaces being closed with respective bottom wall portions, said engine including a cooling system for cooling said engine, coolant for said cooling system being discharged from said engine through said driveshaft housing and said lower unit, and each one of said bottom wall portions having a drain through which the coolant passes to said lower unit.

13. An outboard motor as set forth in claim 12, wherein said rib has an opening through which said sub-spaces communicate with each other.

14. An outboard motor as set forth in claim 13, wherein said opening is disposed generally at a bottom end of said rib.

15. An outboard motor comprising a power head containing an internal combustion engine, a driveshaft housing depending from said power head and containing a driveshaft driven by said engine and extending generally vertically through a front portion of said driveshaft housing located on a forward side of a central longitudinal axis of the driveshaft housing, a lower unit depending from said driveshaft housing and containing a propulsion device driven by said driveshaft, and means for reinforcing said driveshaft housing against force transversely acting thereon, said means for reinforcing said driveshaft housing being disposed within said front portion of said driveshaft housing, said means for reinforcing said driveshaft housing generally upwardly extending from a bottom of said driveshaft housing.

16. An outboard motor as set forth in claim 15, wherein said means for reinforcing said driveshaft housing extends generally normal to a major axis of said driveshaft housing that extends between fore and aft ends of the driveshaft housing.

17. An outboard motor as set forth in claim 15, wherein said means for reinforcing said driveshaft housing extends generally up to a middle height position of said driveshaft housing.

18. An outboard motor as set forth in claim 15, wherein said engine includes an exhaust system for discharging exhaust gases from said engine, said exhaust system having an exhaust conduit at least in part extending through said driveshaft housing, and said means for reinforcing said driveshaft housing is disposed between said driveshaft and said exhaust conduit.

19. An outboard motor comprising a power head including an internal combustion engine having an output shaft, a driveshaft housing depending from the power head and arranged to support a driveshaft, the driveshaft being coupled to the output shaft, a lower unit depending from the driveshaft housing and arranged to support a propulsion shaft, the propulsion shaft being coupled to the driveshaft, an exhaust passage arranged to discharge exhaust gases from the engine, the exhaust passage extending through the driveshaft housing at least in part, the driveshaft housing being shaped as a shell having a pair of side shell portions and a bottom shell portion, and a reinforcing member extending transversely between the side shell portions and upwardly from the bottom shell portion.

20. An outboard motor as set forth in claim 19, wherein the bottom shell portion has an opening through which the exhaust passage passes.

21. An outboard motor as set forth in claim 19, wherein the engine includes a water cooling system, water that has cooled the engine is discharged through the driveshaft housing and the lower unit, and the bottom shell portion has a water drain through which the water drained to the lower unit.

22. An outboard motor as set forth in claim 19, wherein the reinforcing member has an opening through which both sides of the reinforcing member communicate with each other.

23. An outboard motor as set forth in claim 19, wherein the reinforcing member decreases in thickness toward a top end thereof.

24. An outboard motor as set forth in claim 19, wherein a top end of the reinforcing member is lower than a top end of the driveshaft housing.

25. An outboard motor as set forth in claim 19, wherein the reinforcing member is unified with the driveshaft housing.

* * * * *

UNITED STATES PATENT AND TRADEMARK OFFICE

CERTIFICATE OF CORRECTION

PATENT NO. : 6,234,855 B1
DATED : May 22, 2001
INVENTOR(S) : Watanabe et al.

It is certified that error appears in the above-identified patent and that said Letters Patent is hereby corrected as shown below:

Title page,
Item [75], Inventors: should read -- Kazuhiko Watanabe, Hiroyuki Suzuki both of Hamamatsu, Shizuoka (JP) --
Item [73], Assignee: should read -- Sanshin Kogyo Kabushiki Kaisha of Hamamatsu, Shizuoka (JP) --

Signed and Sealed this

Third Day of September, 2002

*Attest:*

*Attesting Officer*

JAMES E. ROGAN
*Director of the United States Patent and Trademark Office*